United States Patent [19]

Takahashi et al.

[11] 4,174,736

[45] Nov. 20, 1979

[54] APPARATUS FOR MANUFACTURING A SLIDE FASTENER STRINGER HAVING A WOVEN COILED COUPLING ELEMENT

[75] Inventors: Kihei Takahashi; Seiko Terada, both of Uozu, Japan

[73] Assignee: Yoshida Kogyo K.K., Tokyo, Japan

[21] Appl. No.: 957,556

[22] Filed: Nov. 3, 1978

[30] Foreign Application Priority Data

Nov. 9, 1977 [JP] Japan ..... 52/134363

[51] Int. Cl.[2] ..... D03D 41/00

[52] U.S. Cl. ..... 139/35; 139/384 B

[58] Field of Search ..... 139/11, 35, 116, 436, 139/384 B

[56] References Cited

U.S. PATENT DOCUMENTS

| | | | |
|---|---|---|---|
| 3,791,417 | 2/1974 | Glindmeyer et al. | 139/35 |
| 3,809,129 | 5/1974 | Muller | 139/436 |
| 3,827,463 | 8/1974 | Glindmeyer et al. | 139/35 |
| 3,828,825 | 8/1974 | Glindmeyer et al. | 139/35 |
| 3,982,566 | 9/1976 | Glindmeyer et al. | 139/35 |

*Primary Examiner*—Henry Jaudon

*Attorney, Agent, or Firm*—Hill, Van Santen, Steadman, Chiara & Simpson

[57] ABSTRACT

An apparatus for manufacturing a woven slide fastener comprises means for weaving a slide fastener stringer tape, a mandrel around which a monofilament is coiled as it is woven into the stringer tape, and a coiling rotor assembly having a pair of wheels rotatably mounted in a pair of housings and on a floating axle to which the mandrel is fixed, and having guide means rotatable for revolving the monofilament in an orbital path around the axle. A pair of plungers jointly or individually act between the floating axle and one of the housings along a path diametrically across said orbital path by which the axle is held immovably with respect to said one of the housings. The plungers are retractable one at a time out of the orbital path so as to allow the monofilament and the guide means to cross the path of movement of the plungers.

9 Claims, 12 Drawing Figures

APPARATUS FOR MANUFACTURING A SLIDE FASTENER STRINGER HAVING A WOVEN COILED COUPLING ELEMENT

BACKGROUND OF THE INVENTION

1. Field of the Invention

The present invention relates to an apparatus for manufacturing a slide fastener stringer including a woven stringer tape and a coiled fastener element woven into the stringer tape along a longitudinal edge thereof.

2. Prior Art

Known apparatus for producing a slide fastener stringer of the type described above generally comprise a shuttleless loom such as a needle loom for weaving a stringer type and a rotor assembly operatively associated with the loom for supplying a monofilament and a core thread, the rotor assembly including a mandrel for extending along a longitudinal edge of the tape being formed, and adjacent to the fell of the tape. The rotor assembly winds or coils the monofilament around the mandrel and the core thread fed therealong, thereby forming the coiled fastener element reinforced with the core thread as they are woven into the tape by being interlaced with weft threads inserted by filling carriers of the loom.

The rotor assembly comprises a housing, a wheel or rotor rotatable in the housing and having an axial off-center hole through which the monofilament passes, and a hollow axle around which the wheel is rotatable and through which the core thread is supplied, the mandrel being fixed to the axle. Since during operation of the apparatus the wheel revolves so as to turn the monofilament in an oribital motion around the axle, the axle floats in the wheel and is held nonrotatable only by the mandrel that engages the coiled fastener element wound therearound and woven into the stringer tape. Therefore, the axle is liable to get jiggled and turned about its own axis due primarily to frictional engagement with the revolving wheel and to vibrations transmited from the mandrel around which monofilament coiling action takes place. Such movements of the axle in turn amplify vibratory movements of the mandrel, which grow greater and greater as the wheel rotates at higher speeds. This condition has led to drawbacks in that the monofilament being coiled can be shaped irregularly and the weft threads being inserted tend to get loosened at the tape edge. Furthermore, the filling carriers which reciprocate across the mandrel to insert the weft threads may collide with the vibrating mandrel, whereby the mandrel can be bent or broken.

SUMMARY OF THE INVENTION

A coiling rotor assembly in the apparatus comprises a wheel rotatable in a housing and a floating axle around which the wheel is rotatable, the axle supporting a mandrel thereon. The wheel has means for guiding a monofilament so as to revolve the monofilament in an orbital path for coiling the monofilament around the mandrel. A pair of plungers operatively act between the axle and the housing across the orbital path whereby the axle is held at all times stationarily with respect to the housing. One of the plungers is retractable at a time out of the orbital path to allow the guide means to move past the plunger. According to a first embodiment, the plungers are directed diametrically oppositely away from each other and are disposed on a cam follower slidable in a casing fixed to the axle and having a roller received in an eccentric cam groove in a face of the wheel, the housing having a pair of diametrically opposite recesses for receiving the plungers, respectively. A second embodiment comprises a pair of diametrically opposite recesses in a barrel on the axle for receiving a pair of plungers, respectively, that are directed diametrically oppositely toward each other and supported on a plunger carrier slidably mounted on the housing, the plunger carrier being reciprocable by means of a cam follower having a roller engaging an eccentric cam.

It is an object of the present invention to provide an apparatus for manufacturing a slide fastener stringer with a woven coiled coupling element, the apparatus having a mandrel that is maintained immovably during operation of the apparatus.

Another object of the present invention is to provide an apparatus for manufacturing a slide fastener stringer with a woven coiled coupling element, the apparatus having a rotor assembly for coiling a monofilament around a mandrel at a higher rate and as smoothly, undistortedly, and reliably into the coiled element as possible.

Many other advantages, features and additional objects of the present invention will become manifest to those versed in the art upon making reference to the detailed description and the accompanying drawings in which preferred structural embodiments incorporating the principles of the present invention are shown by way of illustrative example.

DETAILED DESCRIPTION

Figure 1:
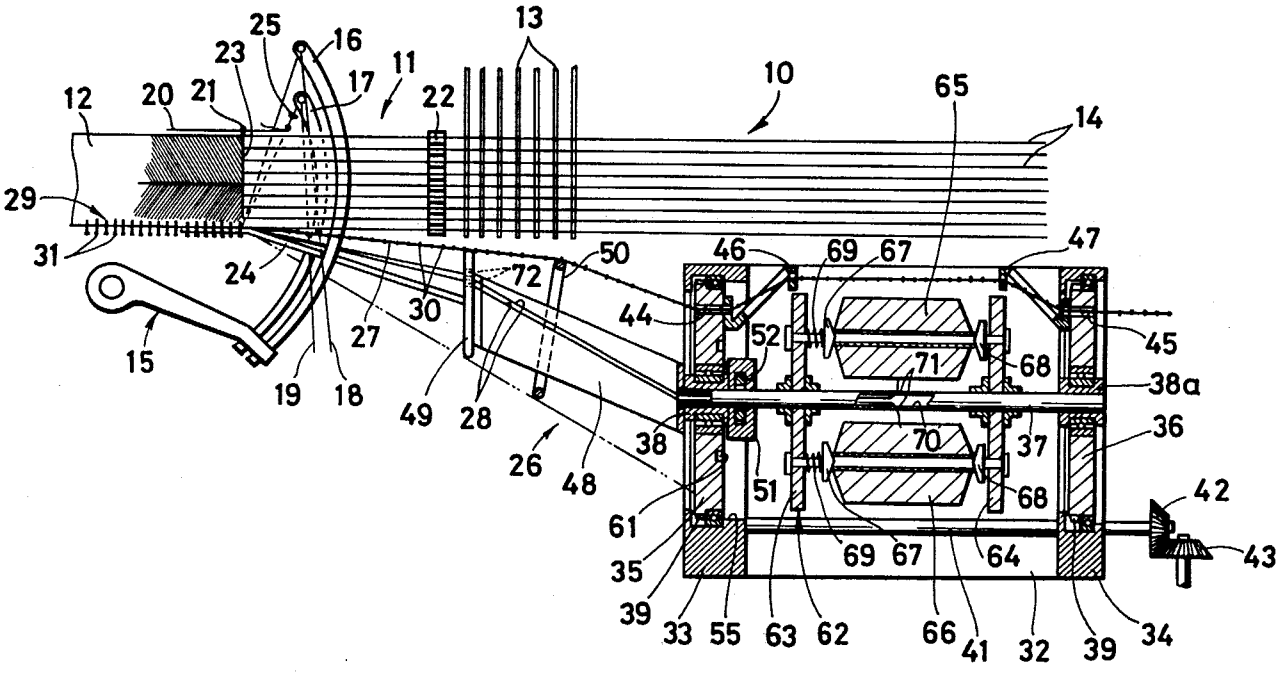
FIG. 1 is a plan view partly in cross section of an apparatus constructed in accordance with the present invention.

The principles of the present invention are particularly useful when embodied in an apparatus such as shown in FIG. 1, generally indicated by the numeral 10.

The apparatus 10 includes a needle loom 11 of a known construction for producing a narrow, continuous slide fastener stringer tape 12, the loom 11 essentially comprising a plurality of harnesses 13 for forming sheds by raising and lowering warp threads 14 selectively, a weft inserter 15 having a pair of upper and lower filling carriers 16, 17 to insert respective weft threads 18, 19 through the warp sheds, a latch needle 20 reciprocable in warp direction alongside of one longitudinal edge of the tape 12 for catching and knitting the weft thread 19 carried by the filling carrier 17 so as to form a tape selvage 21 along said longitudinal tape edge, and a reed 22 for beating the weft thread 19 into the fell 23 of the tape 12.

Figure 2:
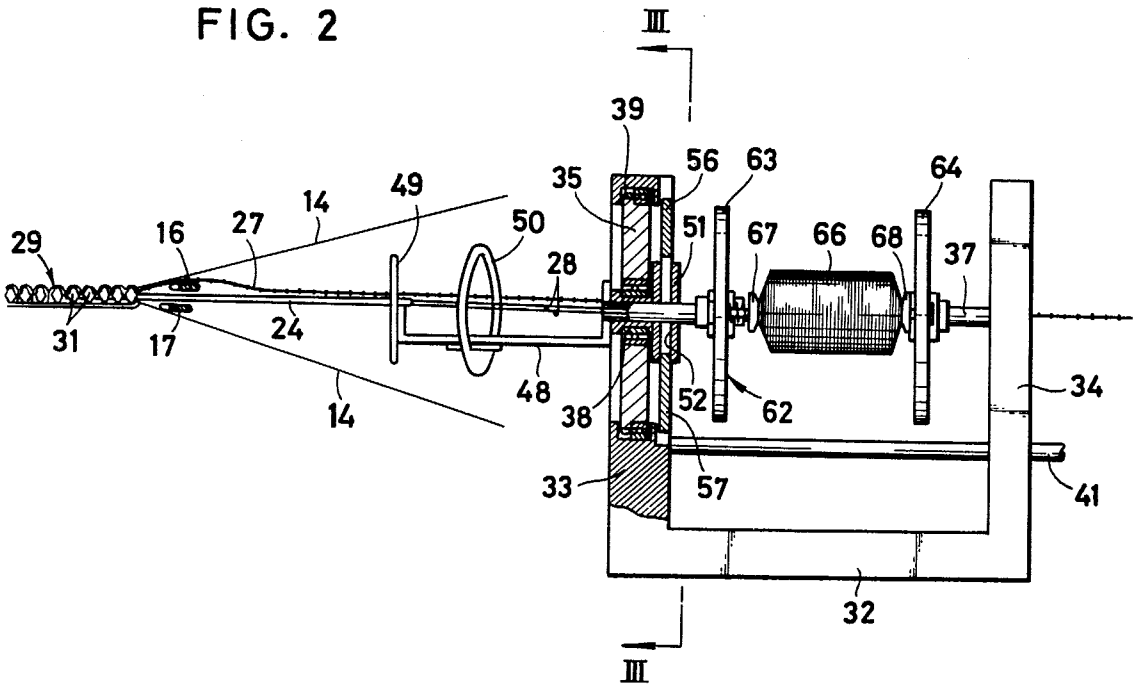
FIG. 2 is a front elevational view with parts in cross section of the apparatus shown in FIG. 1.

As shown in FIG. 2, the filling carriers 16, 17 are vertically spaced from each other to allow a mandrel or coiling needle 24 to extend therebetween. A vertically reciprocable weft lifter 25 (FIG. 1) is located adjacent to the fell 23 and, when the filling carrier 17 is fully inserted across the warp shed, is movable upwardly to engage and raise the weft thread 19 beyond the weft thread 18 so that the latch needle 20 can catch the weft thread 19 reliably.

In apparatus 10 of FIG. 1 further includes a coiling rotor assembly 26 disposed alongside of the warp shed for supplying a monofilament 27 and a pair of core threads 28, 28 and for winding or coiling the monofilament 27 around the mandrel 24 so as to shape the monofilament 27 into a helically coiled fastener element 29 to be disposed along the tape edge remote from the selvaged edge 21. The monofilament 27 is made of plastic material and has a plurality of widened, flattened portions 30 spaced at predetermined intervals therealong, such portions 30 being formed as by stamping. The widened, flattened portions 30 permit the monofilament 27 to be bent or folded over easily at such portions when the monofilament 27 is being coiled, and alternate widened, flattened portions 30 function as coupling heads 31 of the element 29.

The coiling rotor assembly 26 generally comprises a horizontal base 32, a pair of first and second housings 33, 34 spaced from each other and extending upwardly from the base 32, a pair of first and second wheels 35, 36 rotatably mounted in the first and second housings 33, 34, respectively, and a floating axle 37 having a pair of bushings **38, 38*a* fixed to its ends, the wheels 35, 36 being rotatably mounted around the bushings 38, 38*a*, respectively. The wheels 35, 36 have peripheral teeth 39 which mesh in driven relation with gears 40 (only one shown in FIG. 3) disposed respectively in the housings 33, 34 and mounted on a drive shaft 41 having on its one end a bevel gear 42 which is in mesh with and drivable by a bevel gear 43** that is connected to a suitable prime mover such as an electric motor (not shown).

The wheels 35, 36 have a pair of holes 44, 45, respectively, that are aligned with one another and are located eccentrically of the axle 37, and a pair of guides 46, 47, respectively, that are positioned respectively adjacent to the holes 44, 45. A mandrel support 48 is fixedly mounted on the axle 37 and extends horizontally toward the needle loom 11, the support 48 including at its distal end a flange 49 to which the mandrel 24 is secured. A guide ring 50, better shown in FIG. 2, is fastened to the mandrel support 48. The monofilament 27, after having been provided with the widened, flattened portions 30 by a stamping device (not shown), passes through the hole 45, is carried by the guides 47, 46, and then passes through the hole 44. When the wheels 35, 36 are rotated, the monofilament 27 revolves orbitally around the axle 37 and as the monofilament 27 issues from the hole 44, it is guided by the guide ring 50 to rotate around the mandrel support 48. The monofilament 27 is then coiled around the mandrel 24 adjacent to the tape fell 23 to form the coiled fastener element 29 as it is woven into the tape 12 by the weft threads 18,19.

Figure 3:
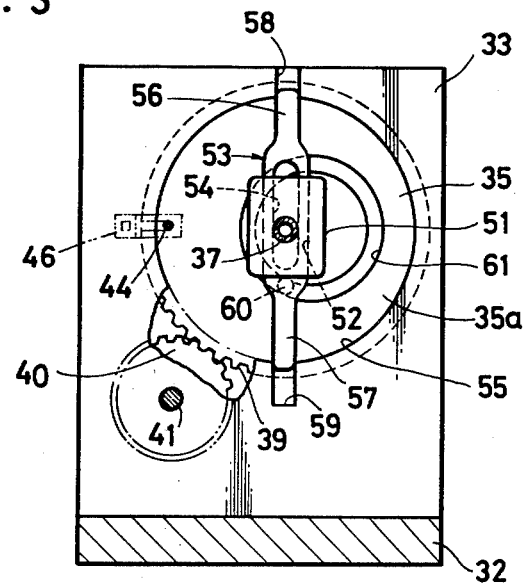
FIG. 3 is a cross-sectional view taken along line III—III of FIG. 2, showing a position of a pair of plungers for immovably holding a floating axle relatively to a housing.

The axle 37 supports thereon a casing 51 having a vertical slot 52 extending therethrough. As best illustrated in FIG. 3, a cam follower 53 is slidably disposed in the vertical slot 52 and has a vertically oblong hole 54 through which the axle 37 extends. The cam follower 53 has a pair of upper and lower plungers 56, 57 directed away from each other and movable along a diametrical path across the wheel 35 when the cam follower 53 reciprocates in the slot 52. The housing 33 has a circular opening 55 concentric with the wheel 35, and a pair of diametrically opposite, upper and lower recesses 58, 59 opening to the circular opening 55 and located radially outwardly of the circular opening 55 and in the path of movement of the plungers 56, 57 for receiving them, respectively. The cam follower 53 has a roller 60 disposed downwardly of the oblong hole 54 and received in a cam groove 61 disposed eccentrically in a face **35*a* of the wheel 35**.

Figure 4:
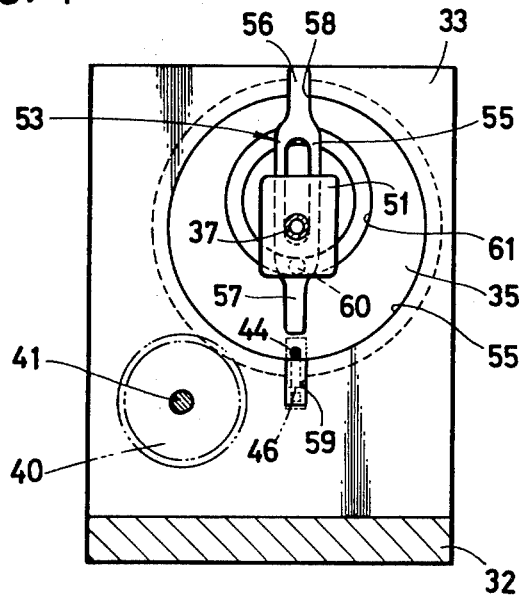
FIGS. 4 and 5 are views similar to FIG. 3, illustrating successive positions of the plungers.
Figure 5:
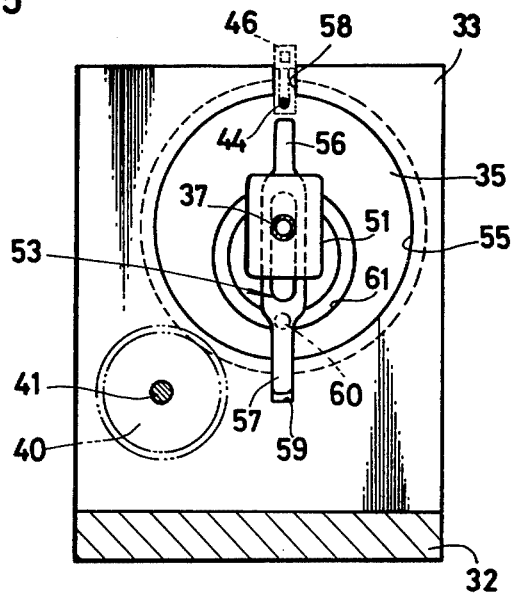
Figure 7:
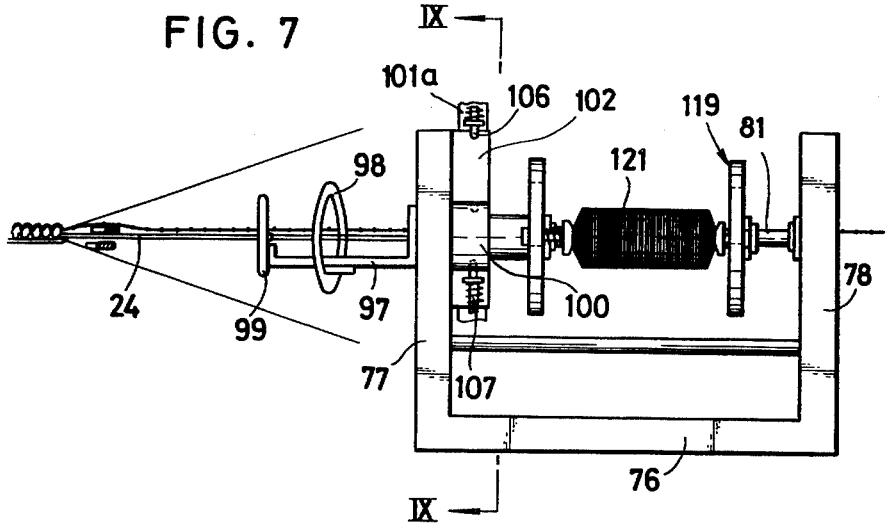
FIG. 7, appearing with FIG. 5, is a front elevational view with portions omitted of the apparatus of FIG. 6.

When the wheel 35 revolves, the guide 46 moves the monofilament in a circular orbit along the edge of the housing 33 which bounds the circular opening 55, such obital path being intersected by the path of movement of the plungers 56, 57. As the guide 46 moves in its orbit past a point that is angularly spaced 90 degrees apart from both the recesses 58, 59 (FIG. 3), the cam follower 53 is substantially in the middle position in its stroke and the plungers 56, 57 are disposed partly in the recesses 58, 59, respectively, and engage the housing 33, so that the axle 37 is held immovably with respect to the housing 33. Assuming that the wheel 33 rotates counterclockwise, when the guide 46 approaches the lower recess 59, the cam follower 53 is caused to move upwardly, with the upper plunger 56 being inserted into the upper recess 58 and the lower plunger 57 being withdrawn out of the lower recess 59. Continued rotation of the wheel 35 places the upper plunger 56 fully in the upper recess 58 and retracts the lower plunger 57 out of the circuilar orbit of the hole 44, as shown in FIG. 4, whereupon the guide 46 clears the retracted lower plunger 57. At this time, the floating axle 37 is maintained stationarily with respect to the housing 33 by the upper plunger 56. As the wheel 35 continues revolving counterclockwise, the cam follower 53 is lowered thereby withdrawing the upper plunger 56 out of the upper recess 58 and inserting the lower plunger 57 into the lower recess 59. Thus, the guide 46 is allowed to move past upper plunger 56 and to cross the path of movement of the cam follower 53, and at the same time, the lower plunger 57 keeps the floating axle 37 immovable relatively to the housing 33.

With such an arrangmment, the floating axle 37 is maintained stationarily with respect to the housing 33 by means of the upper plunger 56, the lower plunger 57, or both, engaging the housing 33 wherever the guide 46 is in its rotational path.

FIG. 1 further illustrates a bobbin mount 62 having a pair of spaced flanges 63, 64 fixed to the axle 37 and supporting therebetween a pair of bobbins 65, 66 of the core threads 28, 28, each bobbin being held in position by means of a pair of bobbin holders 67, 68 mounted on the support flanges 63, 64, respectively. A compression spring 69 normally biases each of the bobbin holders 67, 68 toward one of the bobbins 65, 66 so as to give a suitable degree of resistance to rotation of that bobbin.

The axle 37 has an axial bore 70 and a pair of apertures 71, 71 through which the core threads 28, 28 are supplied from the bobbins 65, 66, respectively into the bore 70. The core threads 28, 28 as they go out of the bore 70 at the end of the axle 37 to which the mandrel support 48 is attached pass respectively through a pair of holes 72, 72 in the flange 49 of the mandrel support 48 so as to be fed along the mandrel 24.

Figure 6:
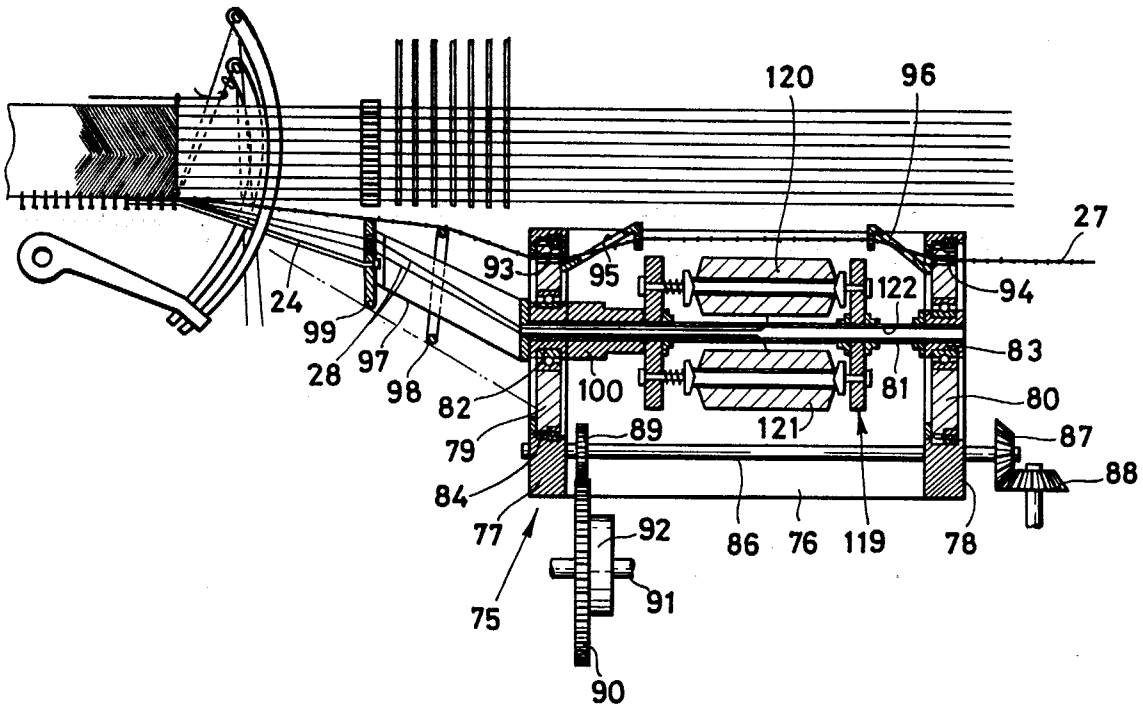
FIG. 6 is a plan view partly in cross section with portions omitted of an apparatus according to a second embodiment of the invention.

As shown in FIG. 6, a coiling rotor assembly 75 constructed in accordance with a second embodiment of the invention basically comprises a base 76, a pair of first and second housings 77, 78, a pair of first and second wheels 79, 80 rotatably supported in the first and second housings 77, 78, respectively, and a floating axle 82 having on its ends a pair of bushings 82, 83 on which the wheels 79, 80 are rotatably mounted, respectively. The first and second wheels 79, 80 have peripheral teeth 84 with which drivingly mesh a pair of gears 85 (only one shown in FIG. 8) supported on a drive shaft 86 (FIG. 6) having on one end a bevel gear 87 meshing with another bevel gear 88 connected to a suitable prime mover (not illustrated). The shaft 86 also suppprts thereon a small-diameter gear 89 which drivingly meshes with a large-diameter gear 90 on a shaft 91 having an eccentric cam 92 rotatable with the large-diameter gear 90.

The first and second wheels 79, 80 have a pair of off-center holes 93, 94 and a pair of guides 95, 96 attached to the wheels 79, 80 near the holes 93, 94, respectively, for guiding the monofilament 27. A mandrel support 97 is fixed to the axle 81 and has a monofilament guide ring 98 and a flange 99 on which the mandrel 24 is mounted.

Figure 8:
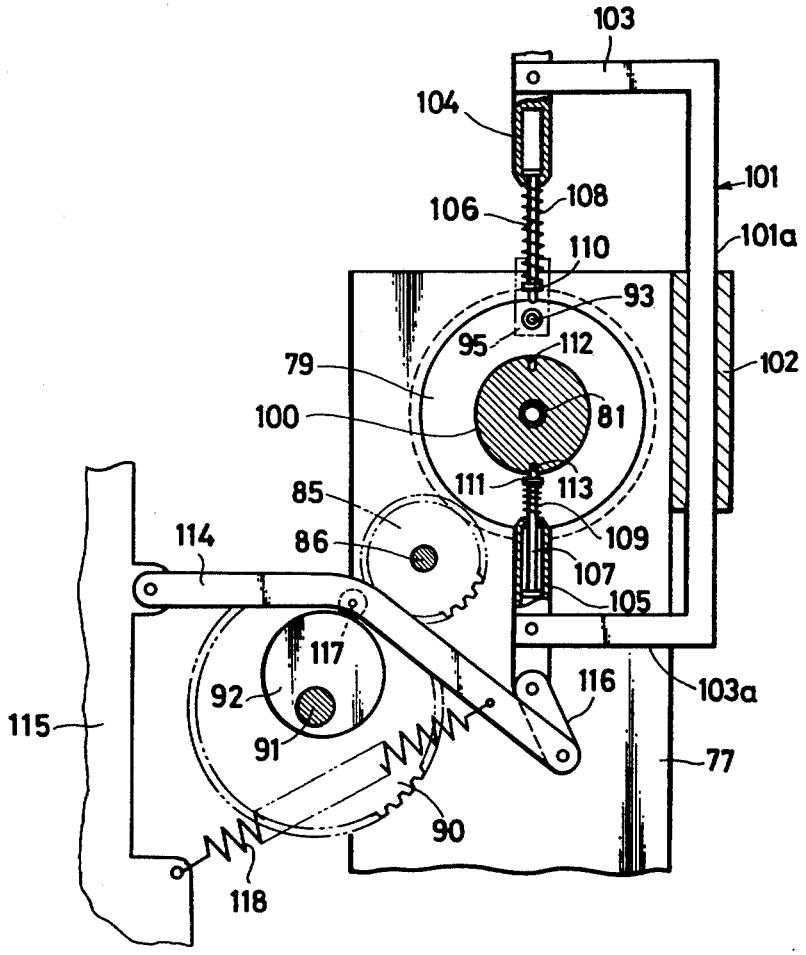
FIG. 8 is a cross-sectional view taken through a rotor assembly.

A barrel or cylinder 100 is coaxially mounted on the axle 81 for rotation therewith. As shown in FIG. 8, a plunger carrier 101 is movably mounted on the housing 77, and has a vertical slide member **101*a* slidably reciprocable through a guide block 102 secured to the housing 77, and a pair of horizontal upper and lower arms 103, 103*a* extending from the ends of vertical slide member 101*a*. A pair of upper and lower supports 104, 105 are mounted respectively on the upper and lower arms 103, 103*a* and are directed toward each other. The upper and lower supports 104, 105 support a pair of upper and lower plungers 106, 107, the supports 104, 105 being hollow to allow the plungers 106, 107 to be partly accommodated therein. A pair of compression coil springs 108, 109 are disposed around the upper and lower plungers 106, 107, respectively, and act between the upper support 104 and a retainer 110 on the plunger 106 and between the lower support 105 and a retainer 111 on the plunger 107 so as to normally urge the upper and lower plungers 106, 107 toward each other. As the plunger carrier 101 moves up and down, the plungers 106, 107 vertically reciprocate along a path that diametrically intersects the wheel 79 and the barrel 100. The barrel 100 has a pair of diametrically opposite recesses 112, 113 located in the path of movement of the plungers 106, 107 and opening away from each other toward the plungers 106, 107**, respectively, for receiving them.

A lever 114 acting as a cam follower is pivatally mounted at its one end on a frame 115 and is connected at the other end to the lower plunger support 105 through a link 116. The lever 114 has a roller 117 located substantially midway between the ends of the lever 114, the roller 117 engaging the eccentric cam 92. A tension spring 118 acts between the lever 114 and the frame 115 to normally bias the roller 117 to be pressed against the cam 92.

Figure 9:
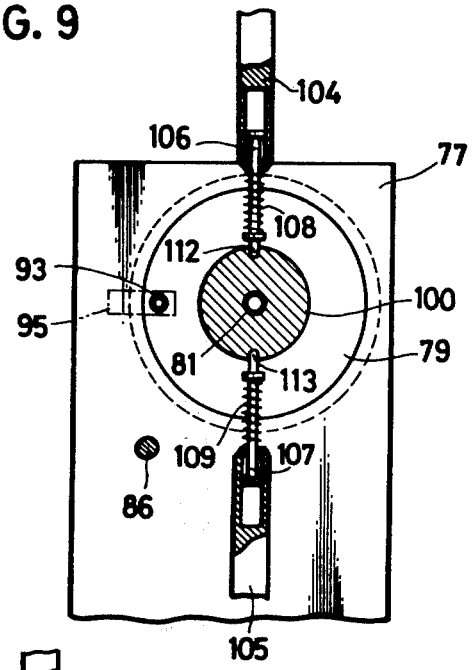
FIG. 9 is a cross-sectional view taken along line IX—IX of FIG. 7, showing a position of a pair of plungers for immovably holding a floating axle relatively to a housing.
Figure 11:
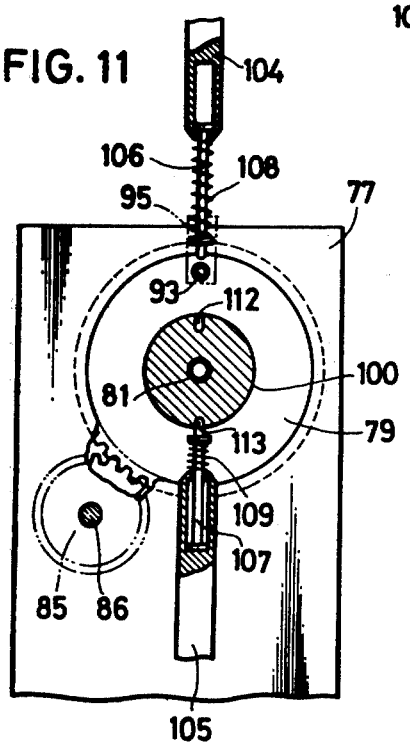
FIGS. 10 and 11 are views similar to FIG. 9, showing successive positions of the plungers.
Figure 10:
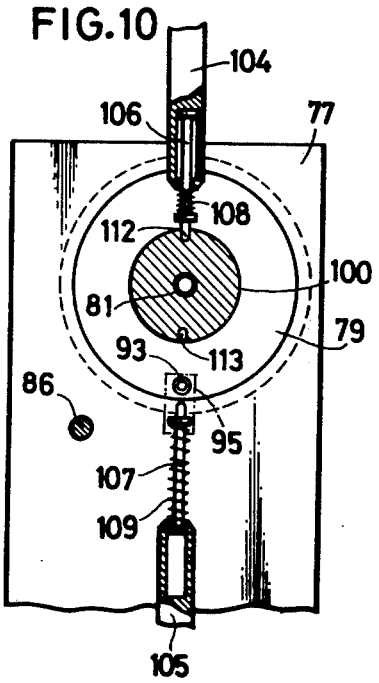

When the drive shaft 86 is rotated, it revolves the wheels 79, 80 via the gears 85, and at the same time revolves the gear 90 via the gear 89, so that the rotation of the first wheel 79 is in synchronism with the reciprocatory movement of the plunger carrier 101. In FIG. 9, when the guide 95, as it progresses in a circular path is angularly spaced 90 degrees apart from the plungers 106, 107, both of the plungers 106, 107 have their distal ends disposed in the recesses 112, 113, respectively, maintaining the axle 81 immovable relatively to the housing 77. As the wheel 79 rotates in the counterclockwise direction, the plunger carrier is lowered to cause the upper support 104 to slide over or take up a length of the upper plunger 106 and to cause the lower plunger 107 to be withdrawn from the recess 113. The plunger carrier moves downwardly until the distal end of the lower plunger 107 is retracted radially outwardly of the circular path of the guide 95, whereupon the guide 95 advances across the path of reciprocation of the plungers 106, 107 and clears the retracted lower plunger 107. At this time, the axle 81 is held stationarily with respect to the housing 77 by the upper plunger 106 (FIG. 10). Continued rotation of the wheel 79 causes the guide 95 to move in its circular path toward the upper plunger 106, which is then lifted away from the recess 112 by upward movement of the plunger carrier. The lower plunger 107 now has its distal end disposed in the recess 113 and keeps the axle 81 immovably in position with respect to the housing 77. The guide 95 then proceeds along the circular path rendered clear of the upper plunger 106.

Accordingly, the upper and lower plungers 106, 107 jointly or individually support the floating axle 81 stationarily with respect to the housing 77 without interfering with rotational movement of the guide 95.

In FIG. 6, the axle 81 also supports a bobbin mount 119 on which there are supported a pair of bobbins 120, 121 from which the core threads 28 are supplied through a bore 122 in the axle 81.

Figure 12:
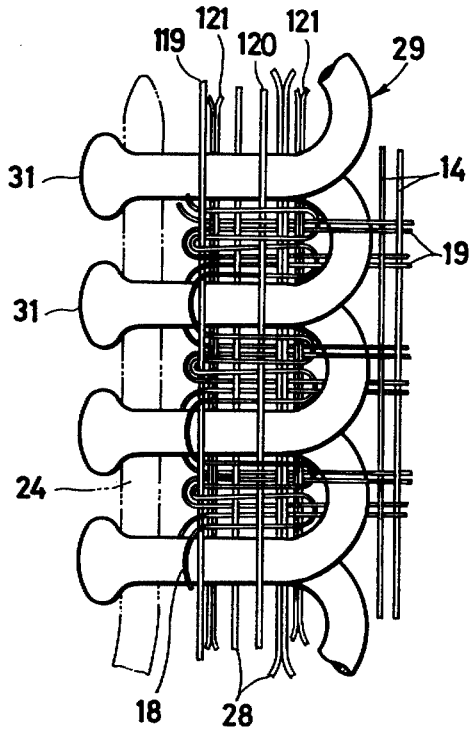
FIG. 12 is a fragmentary front view of a slide fastener stringer produced by the apparatus of the present invention.

FIG. 12 shows, on an enlarged scale, the helically coiled coupling element 29 woven with the weft threads 18, 19, the coupling element 29 having the coupling heads 31 engaged by the mandrel 24. There are additional warp threads 119, 120, and 121 that run warpwise along the coupling element 29 and are interwoven with the weft threads 18, 19 for fastening and covering the coupling element 29. Inclusion of such additional warp threads 119, 120, and 121 has been practiced in the art and does not constitute the present invention.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. An apparatus for manufacturing a slide fastener stringer including a stringer tape, woven of warp and weft threads, and a coiled fastener element woven into the stringer tape along a longitudinal edge thereof, comprising:

(a) means for weaving the stringer tape, said means including means for shedding warp threads and a filling carrier for inserting a weft thread through the warp shed;

(b) a mandrel for extending substantially along the warp threads, said filling carrier being reciprocable across said mandrel; and (c) a rotor assembly for winding a monofilament in an orbital path to form the fastener element coiled around said mandrel and woven into the tape by the weft thread, said rotor assembly comprising a housing, a wheel rotatably mounted in said housing and having means for guiding the monofilament, a floating axle around which said wheel is rotatable, said mandrel being supported on said axle, a pair of first and second plungers operatively acting between said axle and said housing across said orbital path by which said axle is held at all times stationarily with respect to said housing, one of said plungers being retractable at a time out of said orbital path, and means for rotating said wheel.

2. An apparatus according to claim 1, including means for reciprocating said first and second plungers along a path diametrically intersecting said orbital path in timed relation with the rotation of said wheel.

3. An apparatus according to claim 2, said reciprocating means comprising an eccentric cam groove in a face of said wheel, a casing mounted on said axle, and a cam follower slidably received in said casing, said cam follower having a roller disposed in said cam groove.

4. An apparatus according to claim 2, said first and second plungers being directed away from each other and disposed on said cam follower, said housing having a pair of first and second recesses diametrically oppositely located in said path of movement of said plungers for receiving said first and second plungers, respectively.

5. An apparatus according to claim 2, said reciprocating means comprising an eccentric cam connected to said rotating means, means carrying said first and second plungers and slidably supported on said housing, and a cam follower connected to said carrying means and having a roller engaging said eccentric cam.

6. An apparatus according to claim 2, said first and second plungers being directed toward each other, means supported on said axle and having a pair of first and second recesses diametrically oppositely located in said path of movement of said plungers for receiving said first and second plungers, respectively.

7. An apparatus according to claim 6, said reciprocating means including a pair of first and second supports on which said first and second plungers are slidably mounted, respectively, and a pair of first and second springs acting between said first support and said first plunger and between said second support and said second plunger, respectively, and normally urging said first and second plungers toward each other.

8. An apparatus for manufacturing a slide fastener stringer including a stringer tape, woven of warp and weft threads, and a coiled fastener element woven into the stringer tape along a longitudinal edge thereof, comprising:

(a) means for weaving the stringer tape, said means including means for shedding warp threads and a filling carrier for inserting a weft thread through the warp shed;

(b) a mandrel for extending substantially along the warp threads, said filling carrier being reciprocable across said mandrel; and (c) a rotor assembly for winding a monofilament in an orbital path around said mandrel to form the coiled fastener element woven into the tape by the weft thread, said rotor assembly comprising first and second spaced housings, first and second wheels rotatably mounted in said first and second housings, respectively, said first and second wheels having means for guiding the monofilament, a floating axle around which said first and second wheels are rotatable, said mandrel being supported on said axle, a pair of first and second plungers operatively acting between said axle and said first housing across said orbital path by which said axle is held at all times stationarily with respect to said first housing, one of said plungers being retractable at a time out of said orbital path, and means for synchronously rotating said first and second wheels.

9. An apparatus according to claim 8, including a bobbin mount supported on said axle and located between said first and second housings for rotatably carrying a bobbin on which a core thread is wound, said axle having an axial bore through which the core thread can be drawn out for being fed along said mandrel.

* * * * *